US007452100B2

(12) United States Patent
Swartfager

(10) Patent No.: US 7,452,100 B2
(45) Date of Patent: Nov. 18, 2008

(54) RETRACTABLE, AUTOMATIC, ON/OFF FLASHLIGHT SYSTEM

(76) Inventor: Peggy Swartfager, 4870 SW. 29th Ter., Fort Lauderdale, FL (US) 33314

( * ) Notice: Subject to any disclaimer, the term of this patent is extended or adjusted under 35 U.S.C. 154(b) by 90 days.

(21) Appl. No.: 11/350,478

(22) Filed: Feb. 9, 2006

(65) Prior Publication Data

US 2007/0183146 A1 Aug. 9, 2007

(51) Int. Cl.
*F21L 4/04* (2006.01)

(52) U.S. Cl. ..... 362/205; 362/192; 362/198; 362/227; 362/258; 362/387

(58) Field of Classification Search ..... 362/205, 362/208, 198, 387, 258, 227, 192, 193; 192/12.2 R; 200/51.15, 61.17, 61.14
See application file for complete search history.

(56) References Cited

U.S. PATENT DOCUMENTS

| | | | | |
|---|---|---|---|---|
| 2,114,266 | A | 4/1938 | Bodor | |
| 2,180,228 | A | 11/1939 | Florman | |
| 2,249,689 | A | 7/1941 | Gelardin | |
| 2,715,676 | A | 4/1955 | Fore | |
| 2,767,574 | A | 3/1956 | Muller | |
| 2,762,037 | A | 9/1956 | Hetzler | |
| 4,819,140 | A | 4/1989 | Griffin | |
| 5,008,784 | A | 4/1991 | Wang | |
| 5,645,147 | A * | 7/1997 | Kovacik et al. | 191/12.2 R |
| 6,296,371 | B1 | 10/2001 | Shiau | |
| RE38,014 | E * | 3/2003 | Bieberstein | 362/206 |
| 6,601,967 | B1 | 8/2003 | Zeller | |
| 2005/0083626 | A1 * | 4/2005 | Bruwer | 361/93.1 |
| 2005/0160614 | A1 * | 7/2005 | Steinich | 33/732 |
| 2005/0265035 | A1 * | 12/2005 | Brass et al. | 362/451 |
| 2005/0281021 | A1 * | 12/2005 | Thompson | 362/157 |
| 2007/0008719 | A1 * | 1/2007 | Hill | 362/198 |

* cited by examiner

*Primary Examiner*—Sandra O'Shea
*Assistant Examiner*—Mark Tsidulko
(74) *Attorney, Agent, or Firm*—Laurence A Greenberg; Werner H Stemer; Ralph E Locher

(57) ABSTRACT

A retractable, automatic, on/off flashlight system includes a retriever having a retriever spring and a line to be retracted by the retriever spring into the retriever in a retraction direction. A flashlight has a light source, a power source and a switch connected in a circuit. The switch has an actuator connected to the line. The actuator closes the switch and turns on the light source upon pulling the flashlight and the line away from the retriever in an extension direction.

7 Claims, 2 Drawing Sheets

RETRACTABLE, AUTOMATIC, ON/OFF FLASHLIGHT SYSTEM

BACKGROUND OF THE INVENTION

1. Field of the Invention

The invention relates to a retractable, automatic, on/off flashlight system. Such a system is to be used wherever a flashlight is needed to be illuminated for a brief period of time, with a minimum amount of effort by the user and where conditions do not permit the user to look for the flashlight or a switch. For example, police and fire rescue personnel may enter a dark room, construction workers or janitors may need to look into a dark space and bar tenders must shine a light into a dark region under a bar. In each case, a particular dark space must be illuminated for viewing an area or finding an object without searching for a flashlight or a switch. After a relatively short period of time, the light needs to be turned off and the hands of the user need to be free again.

2. Description of the Related Art

U.S. Pat. Nos. 2,762,037 and 2,114,266 merely show key chains at the end of a flashlight, with no interaction between the two.

U.S. Pat. Nos. 6,296,371 B1 and 5,008,784 show flashlights wherein a key ring is attached to a button, which is pushed or turned to turn on the flashlight. Similarly, U.S. Pat. No. 2,249,689 has a key ring on a plug, which is turned to switch on the light. Finally, U.S. Pat. No. 2,180,228 has a screw, which is rotated to move to a battery to turn the light on and off. A key chain is connected to the screw.

U.S. Pat. No. 2,715,676 shows a key retainer, which turns on a flashlight when it is moved. U.S. Pat. No. 4,819,140 has a key ring holder, but the light is turned on by pressing a case. U.S. Pat. No. 2,737,574 has a key holder, but the light is turned on by pressing a plunger.

U.S. Pat. No. 6,601,967 B1 shows a housing of a flashlight having a switch control for momentarily or stably turning on a light.

In each of the prior art devices, the flashlight must be found and then a switch must be located and actuated by the user.

A system in which the flashlight is easy to find and the switch is automatically operated for turning the light on and off, would be an advance in the art.

SUMMARY OF THE INVENTION

It is accordingly an object of the invention to provide a retractable, automatic, on/off flashlight system, which overcomes the herein fore-mentioned disadvantages of the heretofore-known devices of this general type, in which the flashlight can be easily located and in which the light source can be turned on and off without manually actuating a switch.

With the foregoing and other objects in view there is provided, in accordance with the invention, a retractable, automatic, on/off flashlight system. The system comprises a retriever having a retriever spring and a line to be retracted by the retriever spring into the retriever in a retraction direction. A flashlight has a light source, a power source and a switch connected in a circuit. The switch has an actuator connected to the line. The actuator closes the switch and turns on the light source upon pulling the flashlight and the line away from the retriever in an extension direction. The actuator opens the switch and turns off the light source upon allowing the flashlight and the line to be retracted in the retraction direction. The flashlight is always located at the retriever and thus is easy to find and the mere pulling and releasing of the flashlight have the effect of turning the light source on and off. Of course, the line may be a chain, etc.

In accordance with another feature of the invention, there is provided a switch spring biasing the actuator to open the switch. The retriever spring has a greater spring constant than the switch spring. In this way, it is assured that pulling the flashlight will always be sufficient to move the actuator and turn on the light.

In accordance with a further feature of the invention, the circuit includes two leads, and the actuator is a plunger having a crosspiece for interconnecting the leads. The crosspiece is moved toward the leads by the retriever spring and away from the leads by the switch spring. A washer is fixed on the plunger and biased by the switch spring for moving the plunger. These features provide a simple and reliable mechanism for spring-loaded operation of the switch.

In accordance with an added feature of the invention, the circuit includes two leads. An inflexible stop is disposed in the retriever and connected to one of the leads. The switch spring is a resilient finger disposed in the retriever and connected to the other of the leads. The actuator is a washer fixed to the line. The resilient finger is biased away from the inflexible stop, and the retriever spring causes the washer to move the resilient finger toward the inflexible stop. This extremely simple switch is disposed in the retriever and therefore the flashlight need not have any switch. The leads may follow the line from the retriever to the flashlight or the line may contain or be the leads.

In accordance with an additional feature of the invention, the switch is a pull switch disposed in the flashlight and having the switch spring, and the actuator is a pull line of the pull switch. This embodiment is very cost-effective since a standard ceiling fan or ceiling light pull switch may be used.

In accordance with yet another feature of the invention, the switch is a cable-actuated position sensor disposed at the flashlight. The sensor has a switch spring and a cable connected between the switch spring and the line for turning on the light source when the cable is extended by a certain distance. Such sensors are standard, self-contained devices having a built-in spring, reel, cable and electrical leads for connection to a circuit.

With the objects of the invention in view, there is also provided a retractable, automatic, on/off flashlight system, comprising a fastener, and a flashlight having a light source, a power source and a cable-actuated position sensor connected in a circuit. The position sensor has a spring-loaded cable connected to the fastener for turning on the light source when the cable is extended by pulling the flashlight a certain distance away from the fastener. Since the sensor has a cable spring-loaded on a reel, there is no need for a retriever with a spring and a spool.

With the objects of the invention in view, there is additionally provided a retractable, automatic, on/off flashlight system, comprising a retriever having a retriever spring and a line to be retracted by the retriever spring into the retriever. A flashlight is connected to the line and has a light source, a power source and a switch connected in a circuit. The switch is a capacitive proximity switch for turning on the light source when the flashlight is touched by a user. Such switches are commonly used for activating valves, for example.

With the objects of the invention in view, there is furthermore provided a retractable, automatic, on/off flashlight system, comprising a retriever having a retriever spring and a line to be retracted by the retriever spring into the retriever. A flashlight is connected to the line and has a light source, a power source and a switch connected in a circuit. The switch includes a pair of elements communicating with each other.

One of the elements is disposed at the flashlight and the other of the elements is disposed at the retriever, for turning on the light source when the elements are spaced a certain distance apart. The elements may communicate through radio waves, acoustic waves or microwaves, for example. Many types of elements may be used in this embodiment, which only requires that the approach or separation of the elements be sensed.

Other features which are considered as characteristic for the invention are set forth in the appended claims.

Although the invention is illustrated and described herein as embodied in a retractable, automatic, on/off flashlight system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
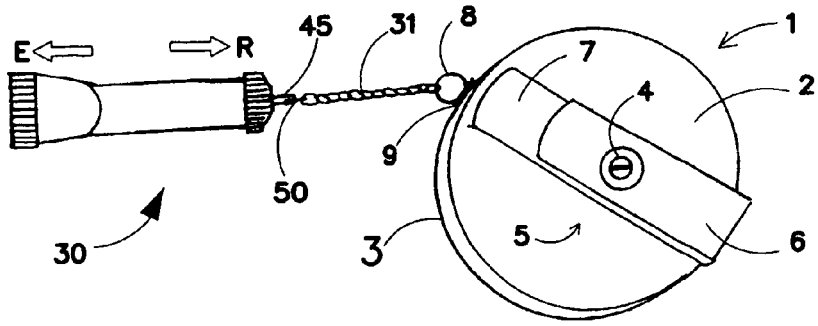
FIG. 1 is a diagrammatic, perspective view of a first embodiment of a retractable, automatic, on/off flashlight system according to the invention.

Referring now to the figures of the drawings in detail and first, particularly, to FIG. 1 thereof, there is seen a retriever 1 having a cover 2 attached to a cup-shaped base 3 by a screw 4. The screw 4 not only holds the cover 2 to the base 3, but also connects a belt clip 5 to the cover. The belt clip 5 has a hole 10 formed in a shorter leg 6 thereof through which the screw 4 may be tightened and a smaller, non-illustrated hole in a longer leg 7 through which the screw holds the belt clip to the cover 2. A chain which is not illustrated in FIG. 1, but will be described in more detail below, is spring-loaded in the retriever 1 and ends at a ring 8 which is retracted against a ferrule 9. Such a retriever is available from The Hillman Group of Cincinnati, Ohio as Model #701290 under the designation Key Retriever.

Figure 2:
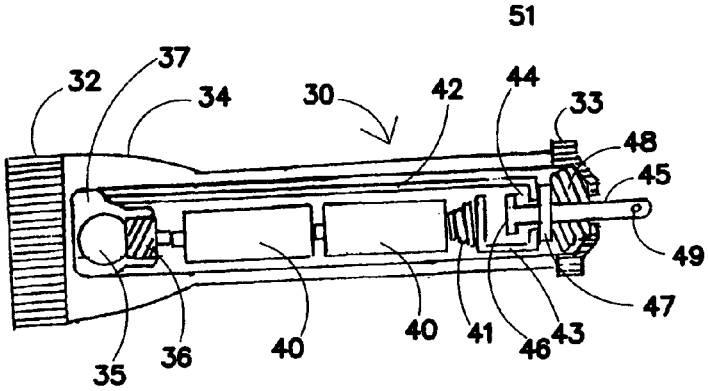
FIG. 2 is an enlarged, partly broken-away, side-elevational view of a flashlight of the first embodiment of the system of the invention.

According to the invention, a flashlight 30 is connected to the ring 8 by another chain 31. As is seen in FIG. 2, the flashlight 30 has a front cap 32 and a rear cap 33, which are screwed onto a hollow body 34. The body 34 contains a light source, such as a bulb 35 having a side terminal screwed or otherwise engaged in a socket 36 which is in turn connected to a reflector 37. However, one or more LEDs may be used instead of the bulb. Batteries 40 are biased against one another and against a base terminal of the bulb 35 by a spring 41. A first lead 42 is electrically connected to the socket 36 and extends toward the rear cap 33 and a second lead 43 is electrically connected to the spring 41 and extends toward the rear cap 33. Both leads 42, 43 are L-shaped in the vicinity of the end cap 33 and terminate with a gap there between. A switch 51 includes an actuator in the form of a plunger 45 which protrudes through the end cap 33 and through the gap 44 and terminates in a conductive crosspiece 46. A non-conductive washer 47 of the switch 51 is fixedly disposed on the plunger 45. A spring 48 normally biases the washer 47 against the L-shaped end of the leads 42, 43. However, if the plunger 45 is pulled to the right in FIG. 2 against the force of the spring 48, the conductive crosspiece 46 electrically interconnects the leads 42, 43 and closes the circuit containing the batteries and the bulb, so that the bulb is turned on. If the plunger 45 is no longer pulled to the right in FIG. 2, the spring 48 moves the washer 47 and with it the plunger and the crosspiece to the left in FIG. 2 and the bulb is turned off. A hole 49 in the end of the plunger is connected to the chain 31 by a ring 50 shown in FIG. 1.

Since the stiffness or spring constant k of the retriever spring is greater than the stiffness or constant k of the switch spring 48, every time the flashlight 30 is extended from the retriever in an extension direction E, the plunger will be pulled and the bulb will turn on. Every time the flashlight is retracted in a retraction direction R, the plunger will be returned to its normal rest position and the bulb will be turned off. It should also be noted that any attachment device could be used in place of a belt clip to attach the retriever to a stationary object, such a piece of furniture or a counter, where the flashlight is to be used.

Figure 3B:
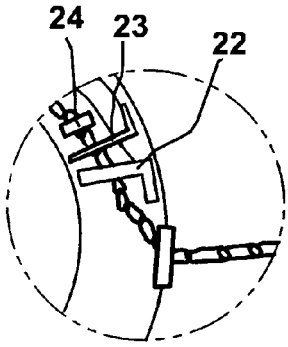
FIGS. 3*a* and 3*b* are enlarged, fragmentary, top-plan views of a portion of the retriever respectively showing a resilient finger pushed against and released from an inflexible stop.
Figure 3:
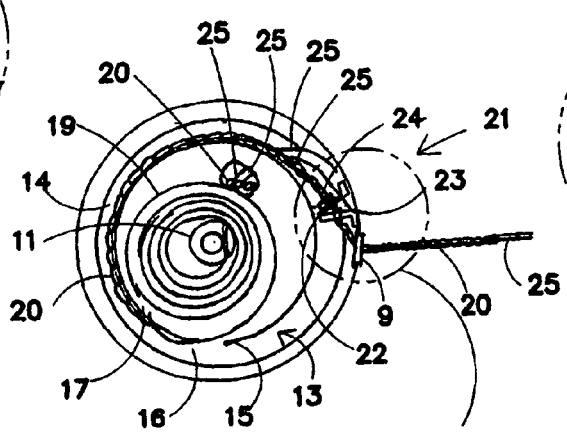
FIG. 3 is a top-plan view of a retriever of a second embodiment of the system of the invention.

In the second embodiment of the invention illustrated in FIG. 3, the retriever 1 is once again shown, but with the cover 2 removed. It can be seen that the cup-shaped base 3 has a threaded socket 11 for receiving the screw 4. A spool 13 has a base portion 14 rotating on the base 3 and a cylindrical portion 15 perpendicular to the base portion 14. The cylindrical portion 15 has an opening 16 and a slot 17. The socket 11 has a slot 18 for receiving one end of a spring 19. The other end of the spring 19 passes through the opening 16 and is locked in place by passing through the slot 17. A chain 20 is wound around the spool 13 between the base portion 14 and the cylindrical portion 15 and has a non-illustrated end connected to the spool 13. A portion of the chain 20 below the base portion 14 near the point of connection to the spool 13 is shown in a broken-away portion of the base portion 14. The chain 20 passes through the ferrule 9 which is disposed in a recess in the base 3. All of the features of the retriever 1 described above are present in the Hillman Key Retriever mentioned above.

Figure 3A:
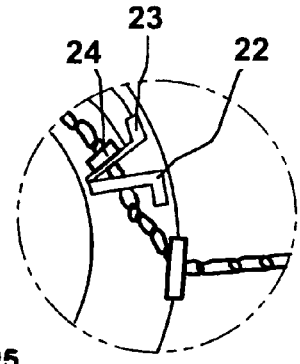

According to the invention, a switch 21 has an L-shaped, inflexible, electrically-conductive stop 22 fixedly mounted to the side of the cup-shaped base 3. The switch 21 also has a switch spring in the from of a resilient, L-shaped, electrically-conductive finger 23 fixedly mounted to the side of the cup-shaped base 3. An actuator in the form of a washer 24 is fixedly connected to the chain 20. In the extended position of the chain 20 shown in FIG. 3*a*, the washer 24 has pushed the tip of the resilient finger 23 against and in electrical contact with the inflexible stop 22. However, when the chain is retracted into the retriever, to the left in FIG. 3, the washer is lifted off the resilient finger 23 as shown in FIG. 3*b* and passes under the base portion 14. Therefore, the resilient finger 23 bounces back to its unbiased condition in which the tip of the finger 23 is moved away from the stop 22.

Two electrical leads 25 are strung along the chain 20 from a non-illustrated flashlight into the retriever 1. The electrical leads 25 protrude beyond the end of the chain at the point of connection to the spool 13. One end of one of the electrical leads 25 is connected to the stop 22 and one end of the other of the electrical leads 25 is connected to the finger 23. The other end of one of the electrical leads 25 is connected to the lead 42 and the other end of the other of the electrical leads 25 is connected to the lead 43 in the flashlight. In contrast to the first embodiment shown in FIG. 2, the flashlight of the second embodiment has no switch integral therewith, but instead the switch 21 will turn on the bulb 35 when the chain 20 is pulled and shut off the bulb 35 when the chain is retracted by the spring 19. The distance by which the chain must be pulled to turn on the bulb is adjustable by suitable placement of the washer 24 along the chain 20.

Figure 4:
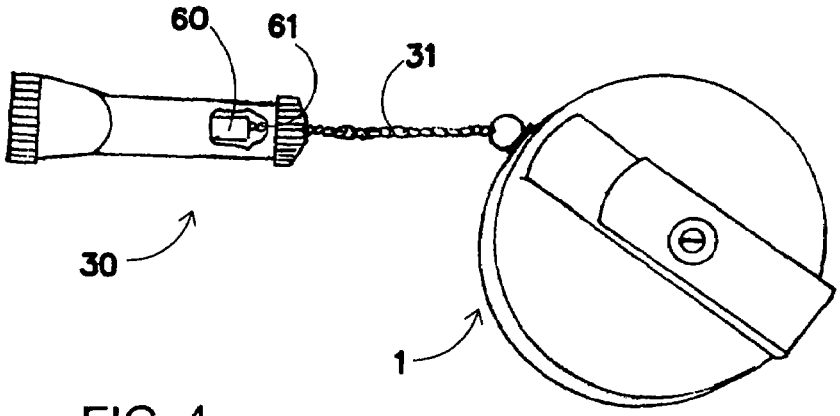
FIG. 4 is a partly broken-away, perspective view of a third embodiment of the system of the invention.

In the third embodiment of the invention illustrated in FIG. 4, a standard pull switch 60, such as is used for a ceiling fan or a ceiling light, is disposed in the flashlight 30. An actuator in the form of a chain 61 of the pull switch is connected between a non-illustrated switch spring in the pull switch 60 and the chain 31 leading to the retriever 1, so that when the flashlight is pulled, the switch 60 will turn on the bulb. When the flashlight is pulled again, after the chain has been retracted by the retriever 1, the bulb will turn off.

Figure 5:
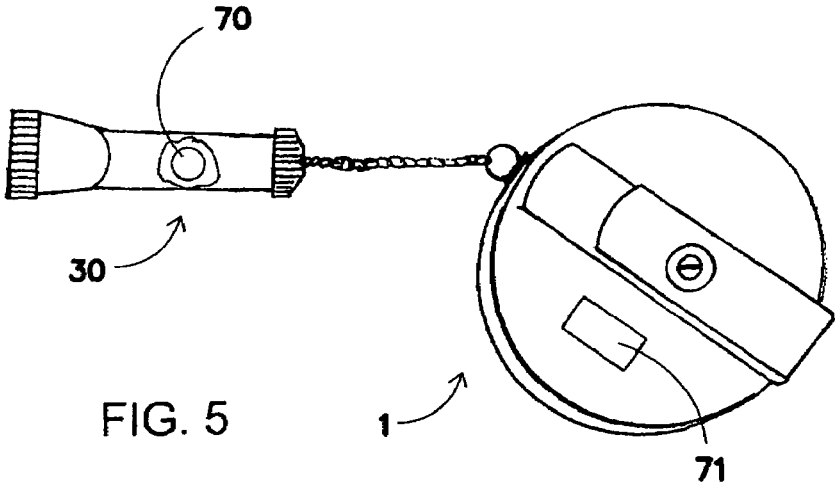
FIG. 5 is a perspective view of a fourth embodiment of the system of the invention.

In the fourth embodiment of the invention illustrated in FIG. 5, an element, such as a capacitive proximity switch 70, is disposed in or on the flashlight 30. When a user approaches or grasps the flashlight, the proximity switch turns on the bulb. When the user releases the flashlight for retraction toward the retriever 1, the bulb turns off. In this case, the proximity switch acts as the switch and the actuator. Alternatively, an element 71 could be placed in or on the retriever 1, forming a transmitting pair with the element 70. Elements 70 and 71 would communicate through radio waves, acoustic waves or microwaves, for instance, so that when the flashlight with the element 70 has been extended a certain distance from the element 71, the bulb would turn on. Element 70 is both the switch and the actuator.

Figure 6:
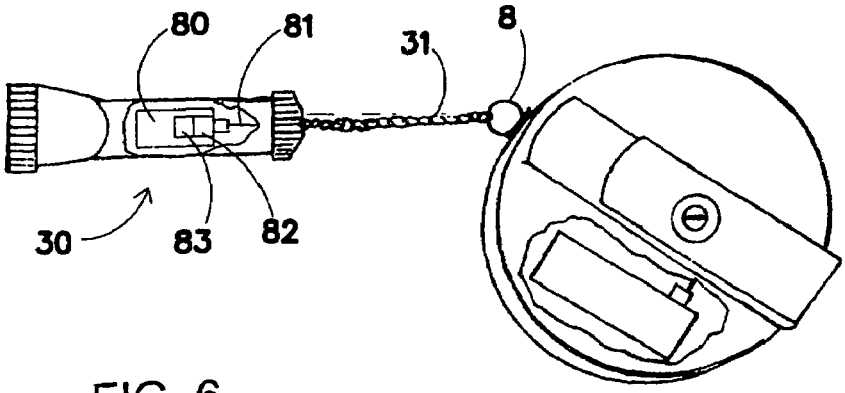
FIG. 6 is a perspective view of a fifth embodiment of the system of the invention.

In the fifth embodiment of the invention illustrated in FIG. 6, a cable-actuated position sensor 80 is disposed in the flashlight 30. The sensor 80 has a cable 81 wound on a reel 82 against the force of a spring 83. The cable 81 is connected to the chain 31. When the cable 81 is extended by a certain distance, the sensor 80 turns on the bulb. When the cable is retracted, the sensor 80 turns off the bulb. In this embodiment, a belt clip or other fastener may be used instead of the retriever, in which case the cable 81 is directly connected to the ring 8 which is fixed in place at the fastener.

In all of the embodiments described above, it is not necessary to use a chain 31 between the retriever 1 and the flashlight 30. Instead, any type of cord, line or cable which is capable of winding on the spool 13 may be used. In the second embodiment of FIG. 3, the leads 25 themselves may replace the chain 31. The use of the generic word "line" in the claims includes all of the possibilities mentioned above.

I claim:

1. A retractable, automatic, on/off flashlight system, comprising:

a retriever having a retriever spring and a line to be retracted by said retriever spring into said retriever in a retraction direction;

a flashlight having a light source, a power source and a switch connected in a circuit;

said switch having an actuator connected to said line;

said actuator closing said switch and turning on said light source upon pulling said flashlight and said line away from said retriever in an extension direction; and said actuator opening said switch and turning off said light source upon allowing said flashlight and said line to be retracted in said retraction direction, regardless of proximity of said flashlight to said retriever.

2. The flashlight system according to claim 1, which further comprises a switch spring in said flashlight biasing said actuator to open said switch, said retriever spring having a greater spring constant than said switch spring.

3. The flashlight system according to claim 2, wherein said circuit includes two leads, said actuator is a plunger having a crosspiece for interconnecting said leads, and said crosspiece is moved toward said leads by said retriever spring and away from said leads by said switch spring.

4. The flashlight system according to claim 3, which further comprises a washer fixed on said plunger and biased by said switch spring for moving said plunger.

5. The flashlight system according to claim 2, wherein said circuit includes two leads, an inflexible stop is disposed in said retriever and connected to one of said leads, said switch spring is a resilient finger disposed in said retriever and connected to the other of said leads, said actuator is a washer fixed to said line, said resilient finger is biased away from said inflexible stop, and said retriever spring causes said washer to move said resilient finger toward said inflexible stop.

6. The flashlight system according to claim 5, wherein said leads follow said line from said retriever to said flashlight.

7. The flashlight system according to claim 5, wherein said line contains said leads.

* * * * *